US007699113B2

(12) United States Patent
Ring

(10) Patent No.: US 7,699,113 B2
(45) Date of Patent: Apr. 20, 2010

(54) APPARATUS AND METHODS FOR RUNNING LINERS IN EXTENDED REACH WELLS

(75) Inventor: Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/206,544

(22) Filed: Sep. 8, 2008

(65) Prior Publication Data

US 2009/0071661 A1 Mar. 19, 2009

Related U.S. Application Data

(60) Provisional application No. 60/973,438, filed on Sep. 18, 2007.

(51) Int. Cl.
*E21B 23/00* (2006.01)
*E21B 4/00* (2006.01)
*E21B 31/00* (2006.01)

(52) U.S. Cl. ..... 166/382; 166/383; 166/207; 166/50; 175/99; 294/86.15; 294/86.24

(58) Field of Classification Search ..... 166/383, 166/207, 50, 380, 208, 382; 175/99; 294/86.15, 294/86.24
See application file for complete search history.

(56) References Cited

U.S. PATENT DOCUMENTS 2,546,978 A * 4/1951 Collins et al. ..... 166/290
5,234,055 A * 8/1993 Cornette ..... 166/278
5,566,772 A 10/1996 Coone et al.
6,085,838 A 7/2000 Vercaemer et al.
6,497,289 B1 12/2002 Cook et al.
6,520,257 B2 * 2/2003 Allamon et al. ..... 166/291
6,899,186 B2 5/2005 Galloway et al.
6,920,932 B2 7/2005 Zimmerman
7,373,988 B2 5/2008 Campbell et al.
2006/0185855 A1 8/2006 Jordan et al.

OTHER PUBLICATIONS

Moore et al.—"A Method for Isolating Pressure-Depleted Zones With Solid Expandable Tubulars", SPE-81095, paper prepared for presentation at the SPE Latin American and Caribbean Petroleum Engineering Conference held in Port-of-Spain, Trinidad, West Indies, Apr. 27-30, 2003, pp. 1-8.
Moore et al.—"A Method for Isolating Pressure-Depleted Zones with Solid-Expandable Tubulars", SPE Drilling & Completion, Dec. 2004, pp. 244-248.

* cited by examiner

*Primary Examiner*—Jennifer H Gay
*Assistant Examiner*—Yong-Suk Ro
(74) *Attorney, Agent, or Firm*—Patterson & Sheridan, L.L.P.

(57) ABSTRACT

An apparatus for running a liner into a wellbore may include an inner string, a device coupled to the inner string that is operable to engage the interior of the liner and facilitates running of the liner into the wellbore, and a control mechanism operable to control fluid communication between the interior of the liner and the wellbore. A method of running a liner into a wellbore may include the steps of positioning an inner string into the liner, wherein the inner string includes a device operable to engage the interior of the liner, engaging the interior of the liner, and supplying a fluid pressure to move the liner relative to the inner string to advance the liner into the wellbore.

35 Claims, 10 Drawing Sheets

APPARATUS AND METHODS FOR RUNNING LINERS IN EXTENDED REACH WELLS

CROSS-REFERENCE TO RELATED APPLICATIONS

This application claims benefit of U.S. Provisional Patent Application Ser. No. 60/973,438, filed on Sep. 18, 2007, which application is herein incorporated by reference in its entirety.

BACKGROUND OF THE INVENTION

1. Field of the Invention

The present invention generally relates to completion operations in a wellbore. More particularly, the invention relates to running casings in extended reach wells.

2. Description of the Related Art

In extended reach wells or wells with complex trajectory, operators often experience difficulty in running a liner/casing past a certain depth or reach. The depth or reach of the liner is typically limited by the drag forces exerted on the liner. If further downward force is applied, the liner may be pushed into the sidewall of the wellbore and become stuck or threaded connections in the liner may be negatively impacted. As a result, the liners are prematurely set in the wellbore, thereby causing hole downsizing.

Various methods have been developed to improve liner running abilities. For example, special low friction centralizers or special fluid additives may be used to reduce effective friction coefficient. In another example, floating a liner against the wellbore may be used to increase buoyancy of the liner, thereby reducing contact forces.

There is a need, therefore, for apparatus and methods to improve tubular running operations.

SUMMARY OF THE INVENTION

In one embodiment, a method of running tubulars, such as liners and casings, include running the tubular to a target depth or to a depth determined by frictional resistance. Then, the tubular may be urged down by generating an active piston force between a seal and a liner shoe.

In one embodiment, an apparatus for running a liner into a wellbore may comprise an inner string having a bore therethrough, and a tubular engagement device coupled to the inner string. The device is operable to engage the interior of the liner. The device is also operable to facilitate movement of the liner relative to the inner string using a fluid pressure.

In one embodiment, a method of running a liner into a wellbore may comprise the step of positioning an inner string in the liner. The inner string may have a seal member operable to engage the interior of the liner. The method may also include the step of pressurizing an internal area between the seal member and the interior of the liner to provide a pressure force against the interior of the liner. The method may further include the step of displacing the liner relative to the inner string using the pressure force.

In one embodiment, a method of running a liner into a wellbore may comprise the step of positioning an inner string into the liner. The inner string may have a piston operable to engage the interior of the liner. The method may also include the step of actuating the piston to engage the interior of the liner. The method may further include the step of displacing the liner relative to the inner string using the piston.

In one embodiment, a method of running a liner into a wellbore may comprise the step of positioning an inner string into the liner. The inner string may have a device operable to engage the interior of the liner. The method may also include the step of engaging the interior of the liner using the device. The method may further include the step of supplying a fluid pressure to move the liner relative to the inner string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In one embodiment, a liner 100 is assembled conventionally on a rig floor. The liner 100 is suspended from the rig floor and held in place using slips, such as from a spider or a rotary table. A false rotary table may be mounted above the slips holding the liner 100. Then, an inner string 120 is run into the liner 100, as shown in FIGS. 1A and 1B.

Figure 1A:
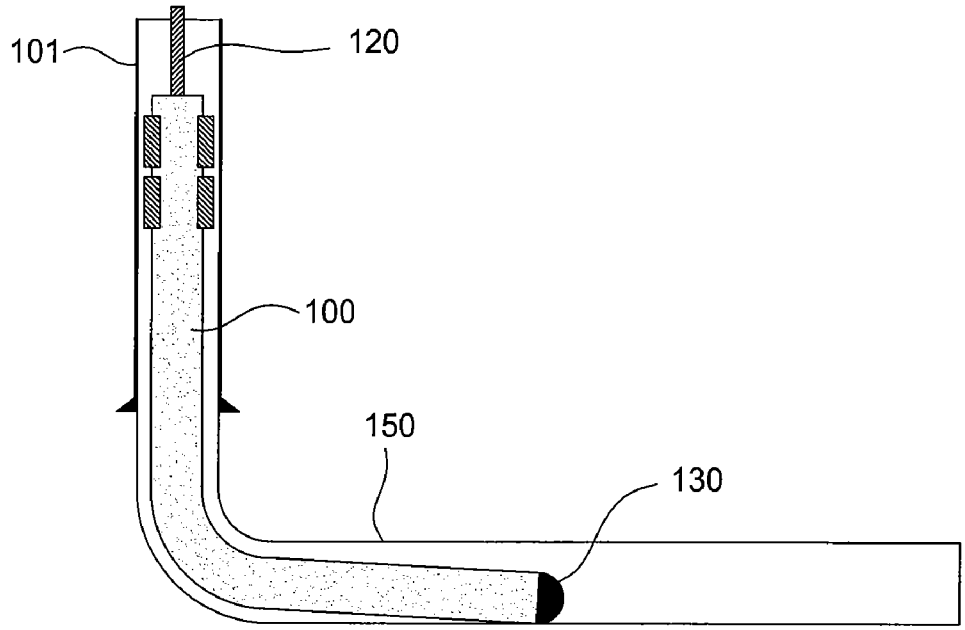
FIGS. 1A and 1B are views of a liner equipped with an inner string having a piston device. The liner is located at a first position in a wellbore.
Figure 1B:
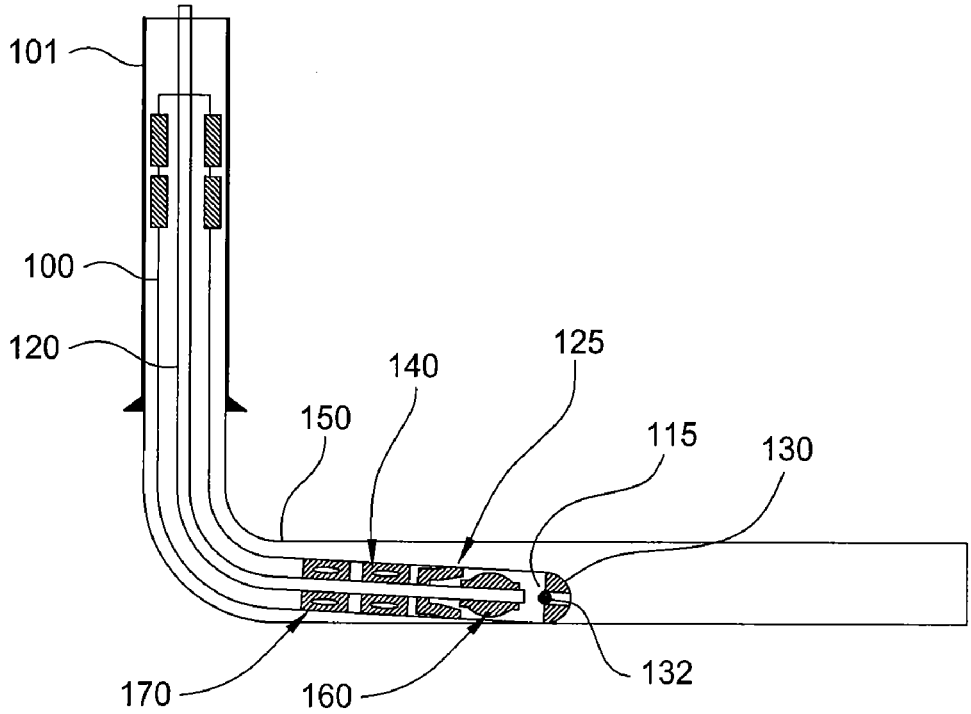

FIG. 1A is an external view of the liner 100, and FIG. 1B is an internal view of the liner 100. The liner 100 may include a casing shoe 130 disposed at an end thereof. A lower portion of the inner string 120 may include a device, such as a seal cup 125, to allow pressurizing the internal area 115 of the liner 100 between the shoe 130 and the seal cup 125. In one embodiment, the inner string 120 may include a piston assembly instead of or in addition too the seal cup 125. The inner string 120 may also include an anchoring or latching device 140 to prevent relative axial movement between liner 100 and the inner string 120. In one embodiment, the inner string 120 may be a drill pipe. The inner string 120 may also include an expansion tool 160, such as a rotary expander, a compliant expander, and/or a fixed cone expander, to expand at least a portion of the liner 100.

The inner string 120 may be run all the way to the shoe 130 or to any depth within the liner 100. After the inner string is located in the liner 100, the anchoring device 140 may be actuated to secure the inner string 120 to the liner 100. After the inner string 120 is assembled, the liner 100 is released from the rig floor and is run into the wellbore 150 to a particular depth. The depth to which the liner 100 is run may be limited by torque or drag forces, as illustrated in FIG. 1A. In one embodiment, a ball 132 or dart is dropped to close a circulation valve at the shoe 130. In another embodiment, circulation may also be closed using a control mechanism, such as a velocity valve or another closure device known to a person of ordinary skill. When the released ball 132 passes by the anchor device 140, the ball 132 may de-actuate the anchor device 140 to release the liner 100 from the inner string 120. After the ball 132 closes circulation, pressure is supplied to increase the pressure in the internal area 115 between the seal cup 125 and the shoe 130. The pressure increase exerts an active liner pushing force against the shoe 130, thereby causing the liner 100 to travel down further into the wellbore 150. In this respect, the active liner pushing force is equal to the pumping pressure multiplied by the piston area within the liner 100. The internal pressurization of the liner 100 may help alleviate a tendency of the liner 100 to buckle as it travels further into the wellbore 150. In one embodiment, the active liner pushing force is provided in a direction that is similar or parallel to the direction of the wellbore 150. In this respect, the effect of the drag forces is reduced to facilitate movement of the liner 100 within the wellbore 150.

After the liner 100 has been extended into the wellbore 150, the pressure in the internal area 115 may be released. The inner string 120 may then be lowered and/or relocated in the liner 100, thereby repositioning the seal cup 125. The tools, such as the seal cups 125, may be positioned at the top or at any location within the liner 100. The seal cups 125 may be stroked within the liner 100 numerous times. The pressure may again be supplied to the internal area 115 to facilitate further movement of the liner 100 within the wellbore 150. This process may be repeated multiple times by releasing the pressure in the liner 100 and re-locating the inner string 120.

In one embodiment, a hydraulic slip 170, or other similar anchoring device, may be coupled to the liner 100 and/or the inner string 120 to resist any reactive force provided on the string or the liner that will push the string or liner in an upward direction or in any direction toward the well surface. The hydraulic slip 170 may be operable to prevent the inner string 120 from being pumped back to the surface, while forcing the liner 100 into the wellbore 150. In one embodiment, the hydraulic slip 170 may be coupled to the interior of the liner 100 to engage the inner string 120. In one embodiment, the hydraulic slip 170 may be coupled to the inner string 120 to engage the liner 100. In one embodiment, the hydraulic slip 170 may be coupled to the exterior of the liner 100 to engage the wellbore 150.

Figure 2A:
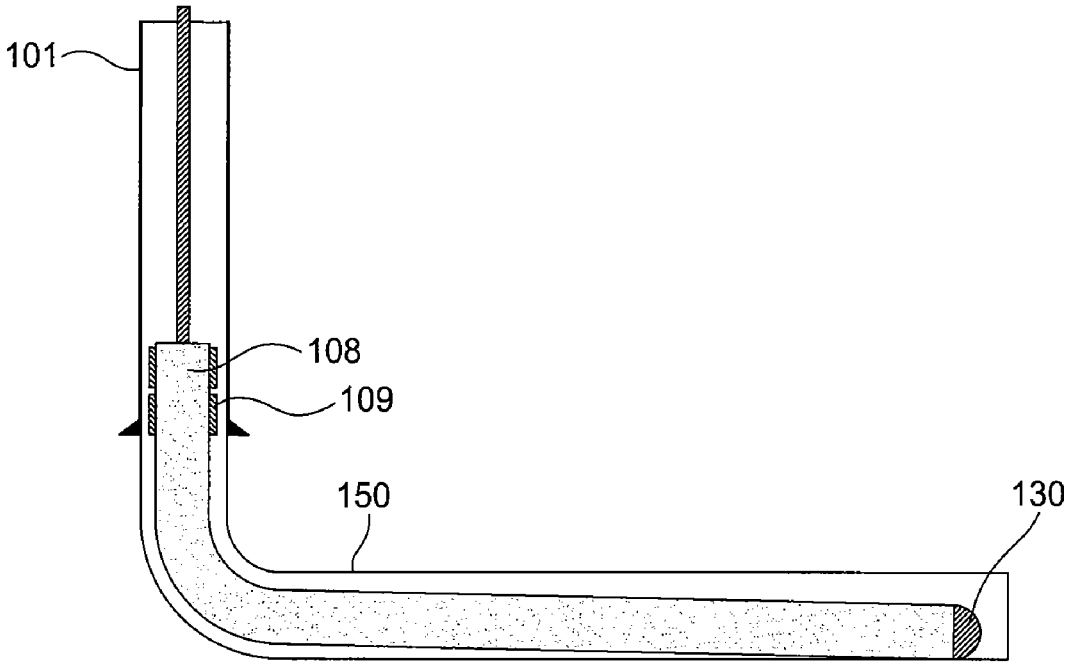
FIGS. 2A and 2B are views of the liner in a second location in the wellbore, the liner being moved by actuation of the piston device.
Figure 2B:
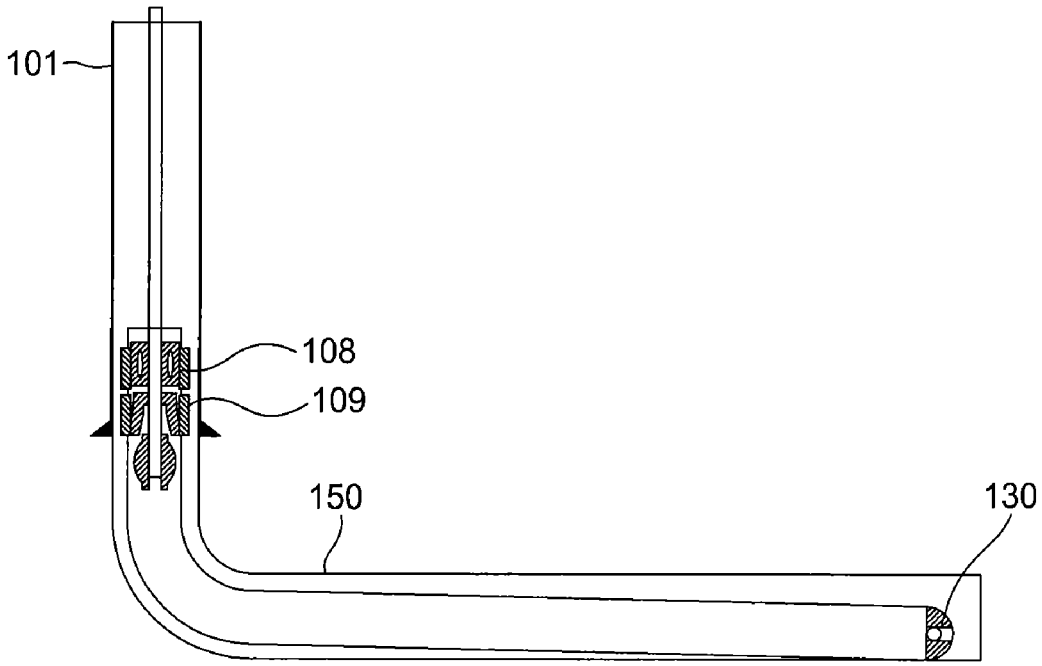

In another embodiment, the liner 100 may optionally include an expandable liner hanger 108, as shown in FIGS. 2A and 2B. As shown, the liner hanger 108 is equipped will a sealing member 109, such as an elastomer. FIG. 2A is an external view of the liner 100, and FIG. 2B is an internal view of the liner 100. When the inner string 120 is pulled all the way to the liner hanger 108, the expansion tool 160 may be activated. The expansion tool 160 may be activated from a (collapsed) travel position to a (enlarged) working position. The liner hanger 108 may be expanded using any tool and technique known in the art. Expansion of the liner hanger 108 anchors the liner 100 and seals the liner top. Alternatively, a conventional liner hanger may be used.

Figure 3:
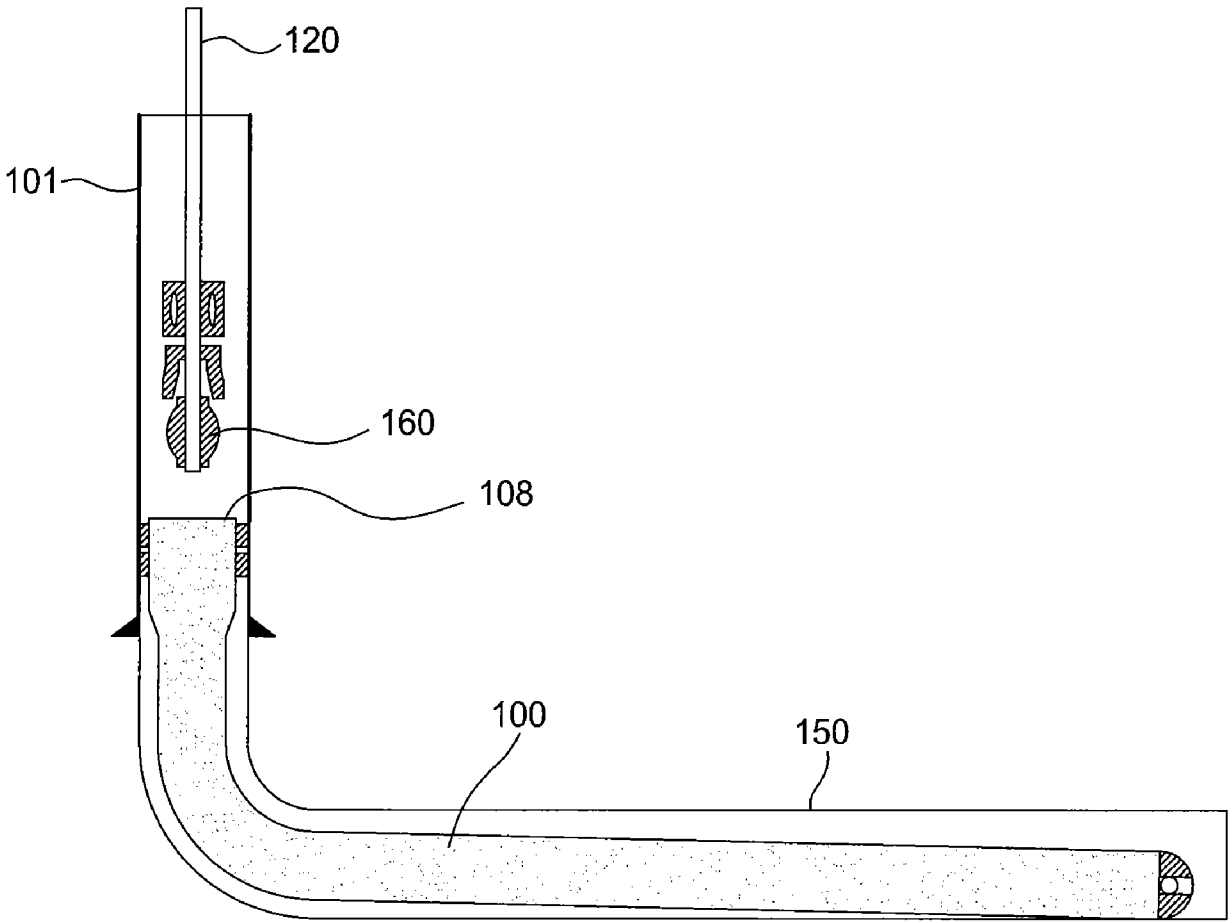
FIG. 3 shows the liner having an expandable liner hanger expanded against a casing.

FIG. 3 shows the liner hanger 108 expanded and set against casing 101. The inner string 120 may then be pulled out of the wellbore 150. In one embodiment, the liner 100 may be cemented in the wellbore 150. In one embodiment, the liner 100 may be radially expanded. In one embodiment, the liner 100 may be expanded at one or more discrete locations to effect zonal isolation or sand production control. In one embodiment, the liner 100 may include a sand control screen, such as an expandable screen.

Figure 4:
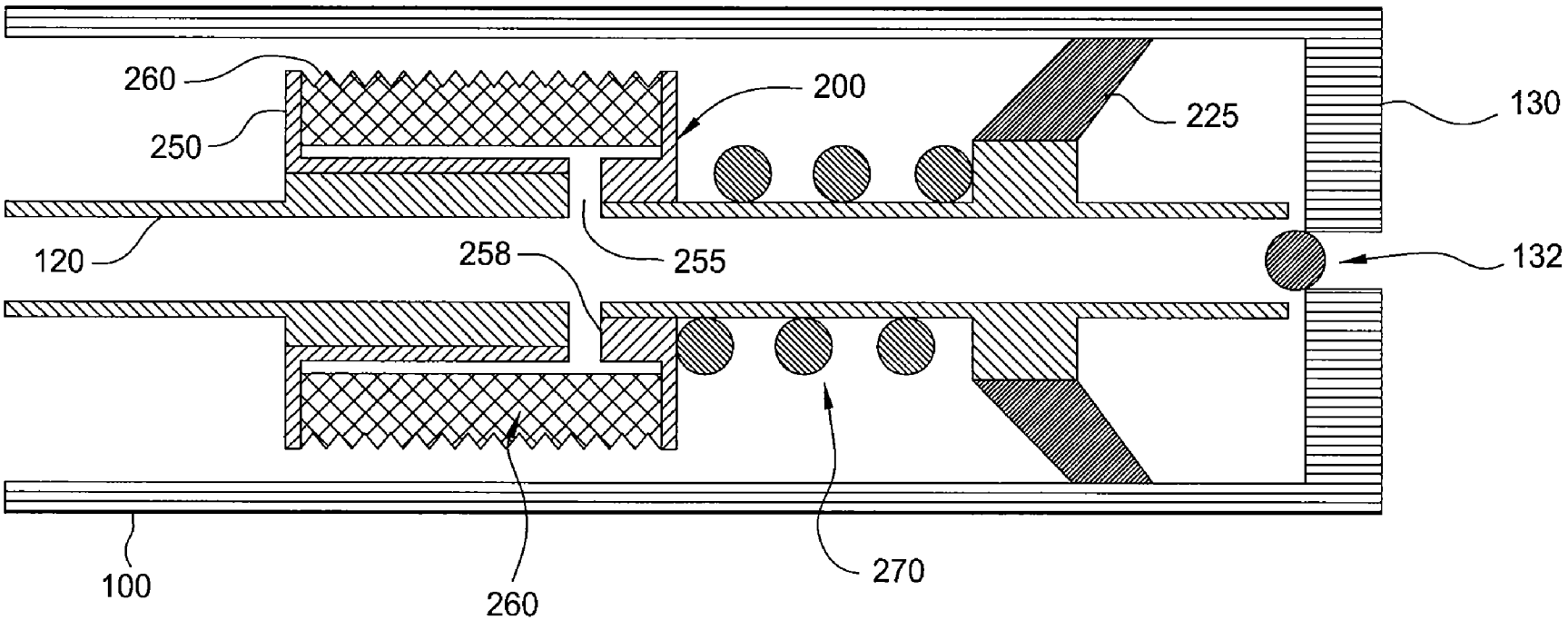
FIG. 4 shows an inner string equipped with another embodiment of the piston device. As shown, the piston device is in the unactuated position.

FIG. 4 shows one embodiment of the inner string 120 (also referred to as a "running tool") equipped with a jack piston device 200. The inner string 120 is shown disposed in a liner 100. The liner 100 is provided with a shoe 130. The inner string 120 includes a seal 225 for sealing against the liner 100. In one embodiment, the piston device 200 includes a housing 250 movably disposed on the exterior of the inner string 120. A port 255 is provided to allow fluid communication between the interior of the inner string 120 and the housing 250. Seals may be disposed between the piston device 200 and the inner string 120. A slip 260 is supported in the housing 250 and is radially movable in response to a pressure in the housing 250.

Figure 5:
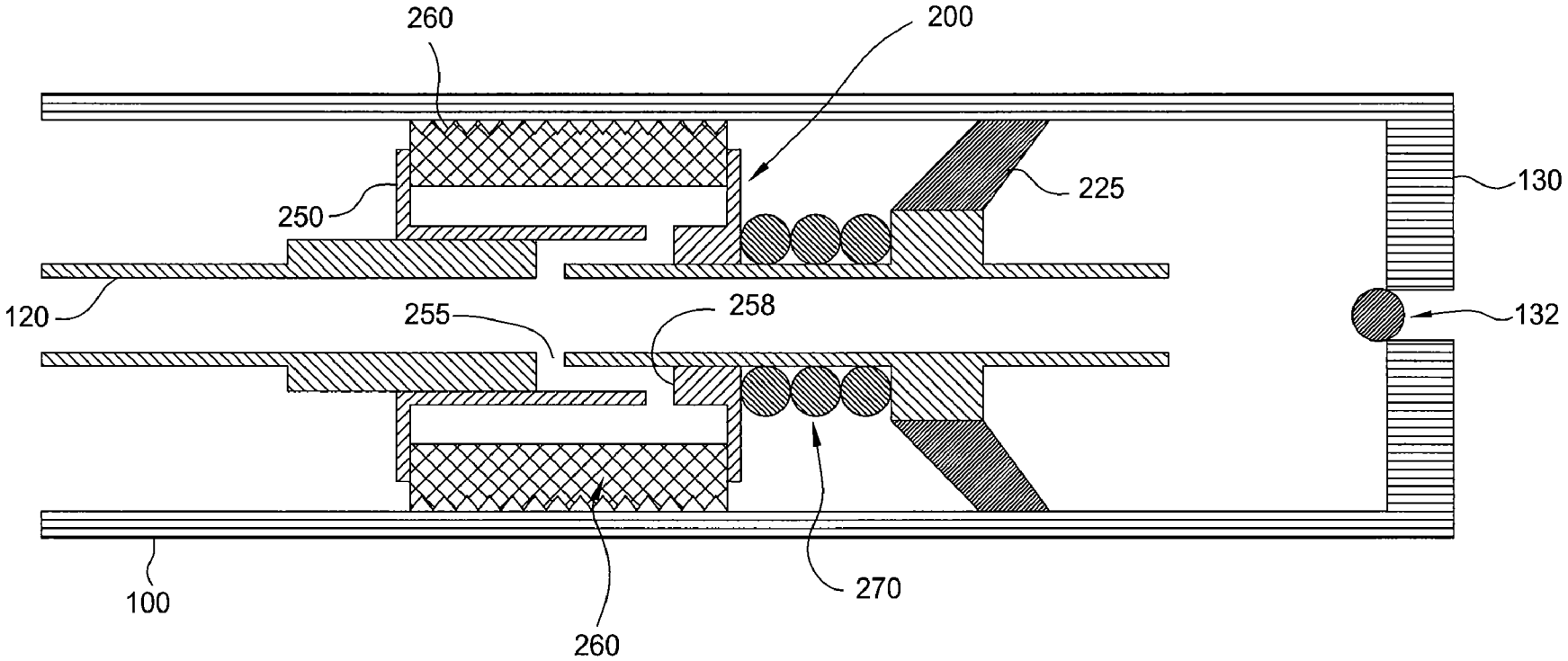
FIG. 5 shows the piston device of FIG. 4 in the actuated position.

In operation, the liner 100 and the inner string 120 may be lowered into the casing 101 to a depth at which further progress is impeded. A ball 132 is released into the liner 100 to seat in a valve in the shoe 130 to close fluid circulation. Pressure increase in the inner string 120 causes the slips 260 to move radially outward into engagement with the liner 100. Further pressure increase causes the piston device 200 to move relative to the inner string 120 and in the direction of the shoe 130. This movement is due to the fluid pressure acting on piston surface 258 provided in the housing 250. Because the piston device 200 is engaged to the liner 100 via the slips 260, the liner 100 is moved along with the piston device 200, thereby advancing the liner 100 further into the wellbore 150. In FIG. 5, it can be seen that the piston device 200 has moved closer to the seal 225 and that the liner 100 has traveled down. After the liner 100 has moved, the pressure in the inner string 120 may be reduced to retract the slips 260. Thereafter, the piston device 200 may be re-pressurized so that the process may be repeated to advance the liner 100 further into the wellbore 150. In one embodiment, the inner string 120 may be repositioned so that the process may be repeated to advance the liner 100 further into the wellbore 150. In one embodiment, the pressure contained by the seal 225 also acts on the liner shoe 130 so that the combination of this pressure plus the force exerted by the piston device 200 pushes the liner 100 further into the wellbore 150.

In one embodiment, a biasing member 270 may be provided to facilitate repositioning of the piston device 200 relative to the port 255. In one embodiment, the biasing member 270 may be a spring that is disposed between the seal 225 and the piston device 200, such that it engages a shoulder on the inner string 120 at one end and engages the housing 250 at the opposite end. As the piston device 200 is moved toward the seal 225, the spring is compressed, as shown in FIG. 5. After the pressure in the inner string 120 is reduced and the slips 260 are disengaged from the liner 100, the spring will exert a biasing force to move the piston device 200 to its original position relative to the port 255.

Figure 6:
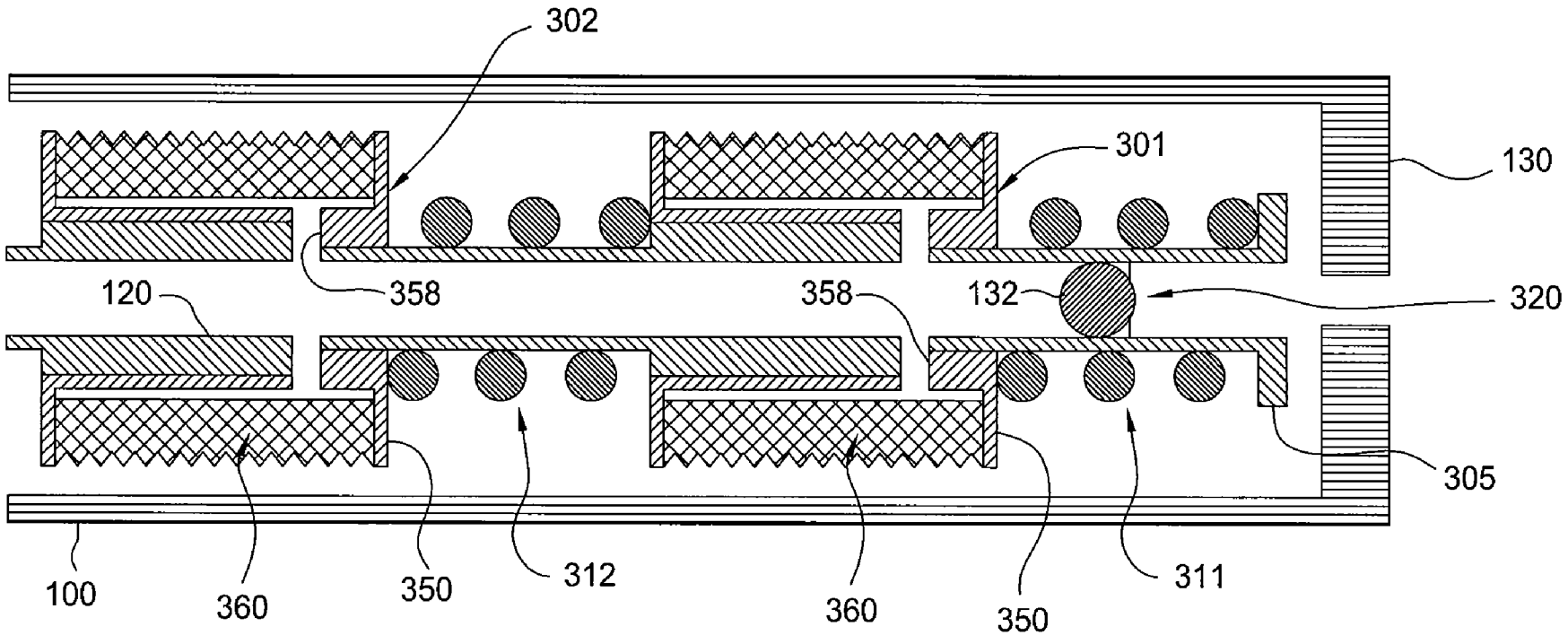
FIG. 6 shows an inner string equipped with yet another embodiment of the piston device. As shown, the piston device is in the unactuated position.

In one embodiment, a plurality of piston devices may be used on an inner string 120. FIG. 6 shows an inner string 120 with two piston devices 301 and 302. In one embodiment, a first biasing member 311 is disposed between a shoulder 305 on the inner string 120 and the first piston device 301, and a second biasing member 312 is disposed between the two piston devices 301 and 302. A landing seat 320 is provided in the inner string 120 to close circulation between the inner string 120 and the liner 100, and/or the inner string 120 and the wellbore 150. In one embodiment, the inner string 120 may be equipped with the seal configuration as shown in FIG. 1B or 4.

In operation, a ball 132 is released into the inner string 120 to seat in the landing seat 320 to close fluid circulation. Pressure increase in the inner string 120 causes the slips 360 to move radially outward into gripping engagement with the liner 100. Further pressure increase causes the piston devices 301 and 302 to move relative to the inner string 120 and in the direction of the shoe 130. This movement is due to the piston surfaces 358 provided in the housings 350 of the piston devices 301 and 302. Because the piston devices 301 and 302 are engaged to the liner 100 via the slips 360, the liner 100 is moved along with the piston devices 301 and 302, thereby advancing the liner 100 further into the wellbore 150.

Figure 7:
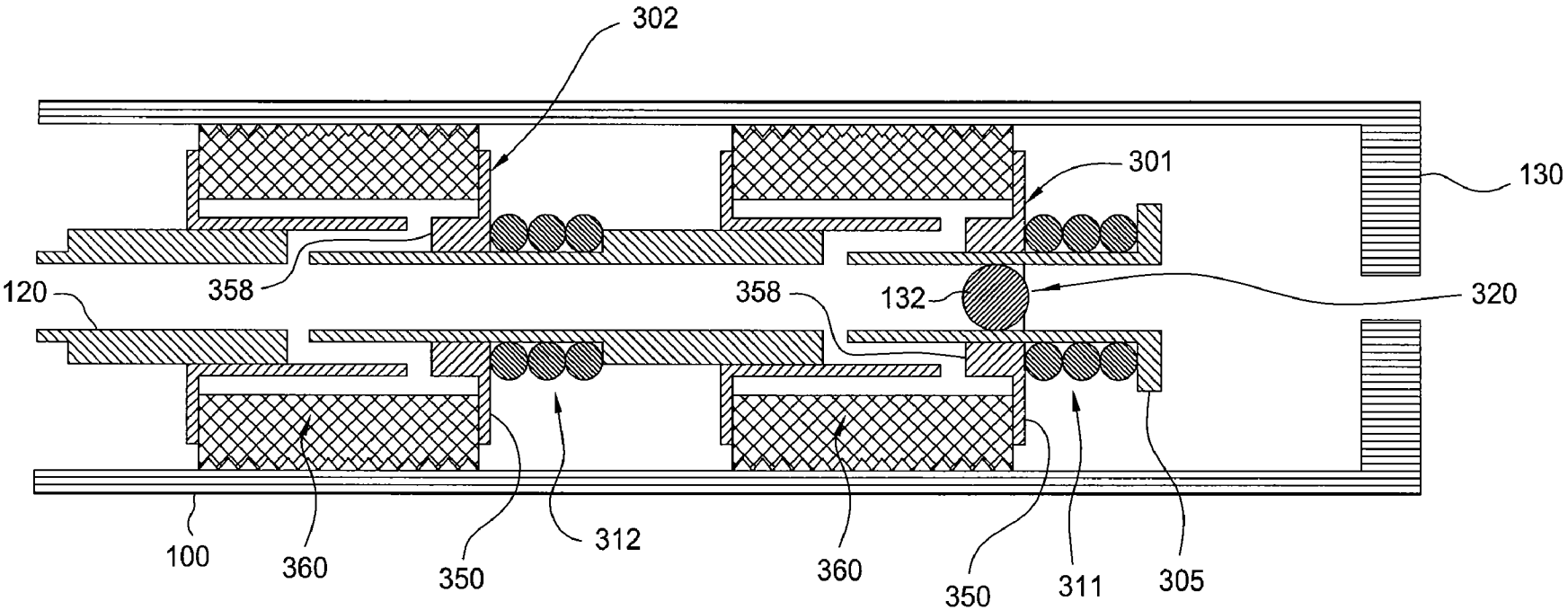
FIG. 7 shows the piston device of FIG. 6 in the actuated position.

In FIG. 7, it can be seen that the piston devices 301 and 302 have moved closer to the shoulder 305 and that the liner 100 has traveled down. After the liner 100 has moved, the pressure in the inner string 120 may be reduced to retract the slips 360. After the pressure is reduced, the biasing members 311 and 312 are operable to move the piston devices 301 and 302 back to their original position. Thereafter, the piston devices 301 and 302 may be re-pressurized so that the process may be repeated to advance the liner 100 further into the wellbore 150. In one embodiment, the inner string 120 may be repositioned so that the process may be repeated to advance the liner 100 further into the wellbore 150.

Figure 8:
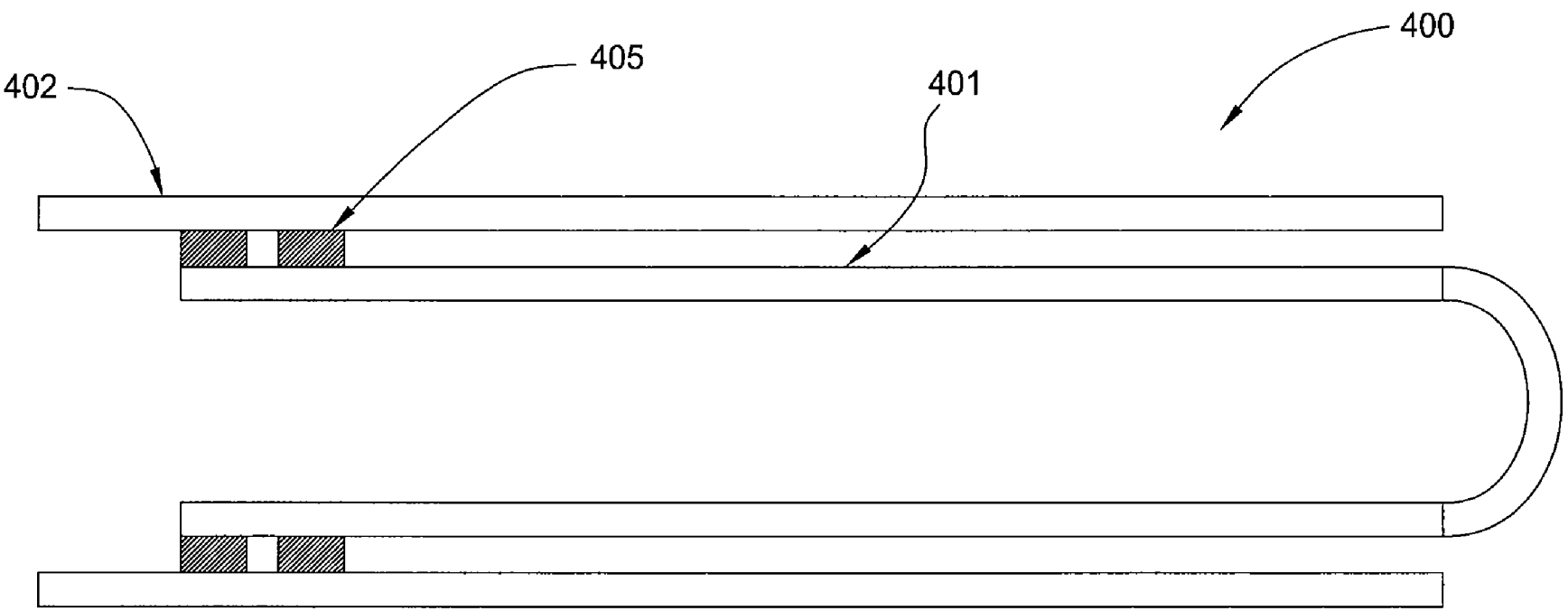
FIG. 8 shows a telescopic liner assembly.

In one embodiment, the inner string 120 may be used to extend a telescope liner assembly 400, as shown in FIG. 8. FIG. 8 shows the liner assembly 400 having an inner liner 401 at least partially disposed within an outer liner 402. One or more seals 405 may be disposed between the inner liner 401 and the outer liner 402. In one embodiment, the inner string 120 disposed in the liner assembly 400 is equipped with a seal piston configuration as shown in FIGS. 1B and/or 4.

Figure 9:
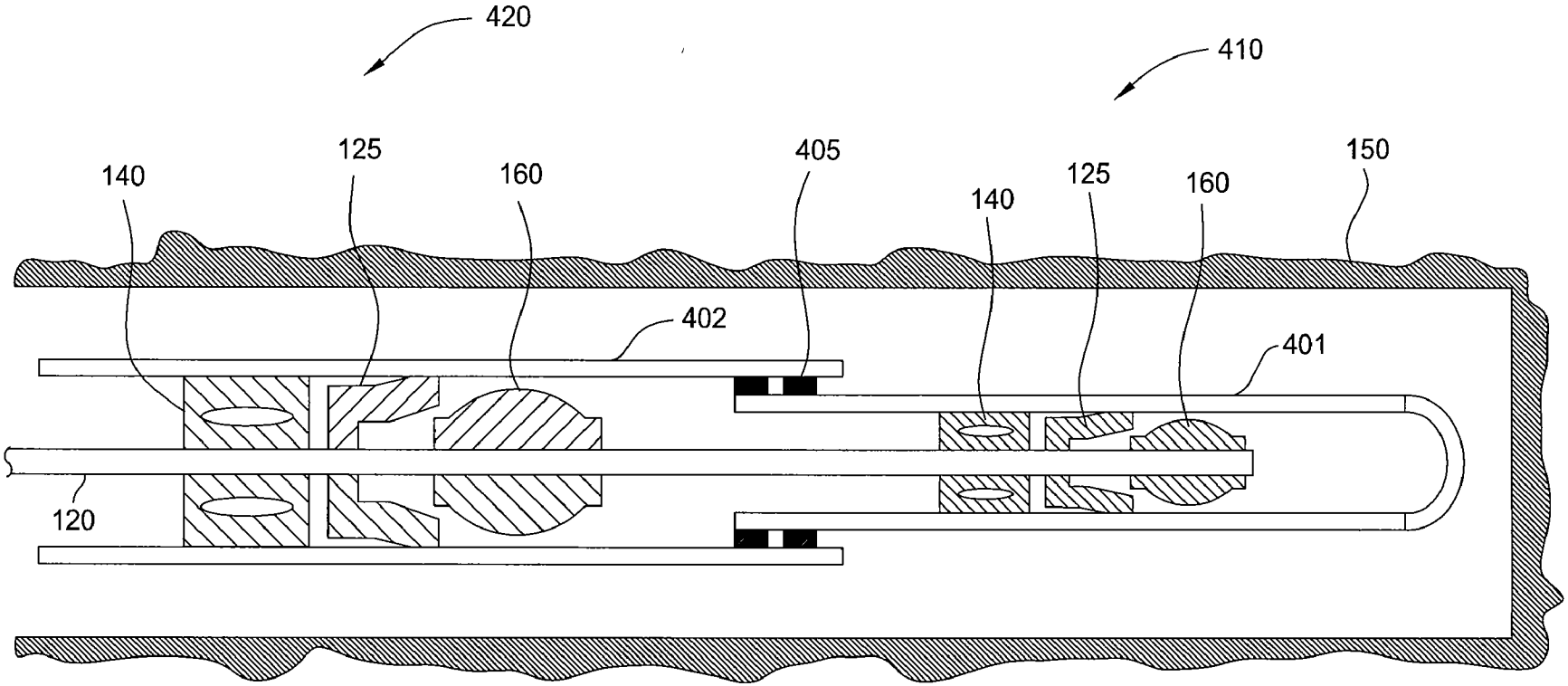
FIG. 9 shows the telescopic liner assembly extended using an embodiment of the piston device.

A seal piston 420 may be positioned in the liner assembly 400 such that the seal 125 is adapted to engage the outer liner 402, as shown in FIG. 9. The seal piston 420 may further include an anchoring device 140 and/or an expansion tool 160. In one embodiment, a seal piston 410 may be positioned in the inner liner 401 such that the seal 125 engages the inner liner 401. The seal piston 410 may further include an anchoring device 140 and/or an expansion tool 160. In one embodiment, the inner string 120 may include two seal pistons 410 and 420 with one located in each liner 401 and 402. In one embodiment, the inner string 120 may equipped with jack piston devices instead of the seal piston and/or both.

In operation, the inner string 120, having either seal piston 420 or 410, or both, may be introduced into the liner assembly 400 and secured in the liner assembly 400 via anchoring devices 125. The inner string 120 and the liner assembly 400 may be lowered into the wellbore 150 to a predetermined depth. As described above, a ball, a dart, or other triggering mechanism may be used to deactivate one or both of the anchoring devices 125 from engagement with the liner assembly 400. Pressure may then be supplied through the inner string 120, thereby pressurizing the liner assembly 400 against the seal pistons 420 and/or 410, and providing an active liner force to telescope the inner liner 401 into the wellbore 150 relative to the outer liner 402. Further pressurization may then allow the inner liner 401 and the outer liner 402 to advance further into the wellbore 150 relative to the inner string 120. The pressure may be released to allow relocation and/or removal of the inner string 120. This process may be repeated to even further advance the liner assembly 400 into the wellbore 150.

In one embodiment, the liner assembly 400 may be equipped with a locking mechanism such that after the inner liner 401 is extended, the piston devices 410 and/or 420 may be used to move the inner liner 401 and the outer liner 402.

In one embodiment, the inner liner 401 and the outer liner 402 may initially be releasably connected. During operation, the inner and outer liners 401 and 402 are moved along in the wellbore 150. At a predetermined depth, the releasable connection may be sheared or otherwise disconnected, thereby allowing the inner liner 401 to be extended relative to the outer liner 402.

Figure 10:
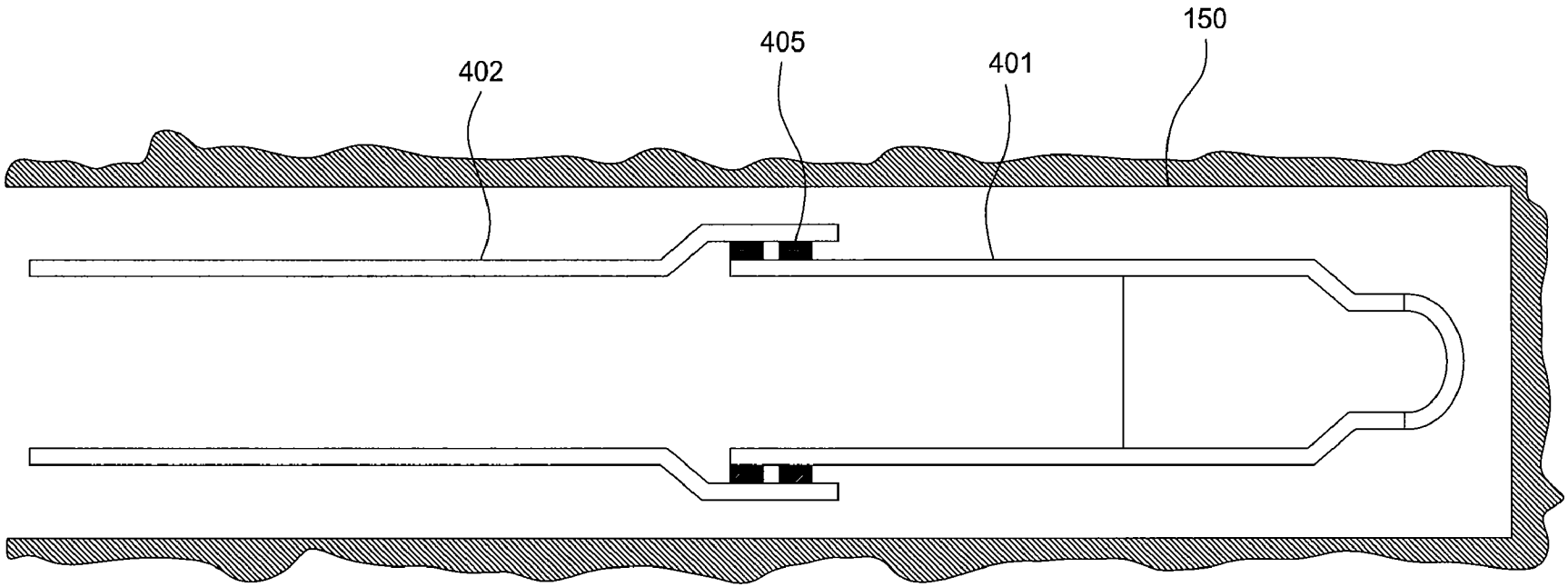
FIG. 10 shows expansion of the telescopic liner assembly after extension.

In one embodiment, after the inner liner 401 has been extended from the outer liner 402, the inner liner 401 may be optionally radially expanded, as shown in FIG. 10. In one embodiment, the outer liner 402 may also be radially expanded.

In further embodiments, the liner (any of 100, 400, 401, 402) may be equipped with a drilling or reaming device at or on the shoe, such that the borehole may be drilled or reamed during the running operation.

While the foregoing is directed to embodiments of the present invention, other and further embodiments of the invention may be devised without departing from the basic scope thereof, and the scope thereof is determined by the claims that follow.

I claim:

1. An apparatus for running a liner into a wellbore, comprising:

an inner string having a bore therethrough; and a tubular engagement device coupled to the inner string, wherein the device is operable to engage the interior of the liner and facilitate movement of the liner relative to the inner string using a fluid pressure, wherein the device comprises a piston movable relative to the inner string using the fluid pressure.

2. The apparatus of claim 1, wherein the device further comprises a seal cup operable to sealingly engage the interior of the liner.

3. The apparatus of claim 1, wherein the piston comprises a slip operable to engage the interior of the liner to advance the liner into the wellbore.

4. The apparatus of claim 3, wherein the piston is in fluid communication with the bore of the inner string to allow fluid actuation of the slip.

5. The apparatus of claim 3, wherein the piston further comprises a piston housing operable to move the piston relative to the inner string to advance the liner into the wellbore upon engagement with the slip.

6. The apparatus of claim 3, wherein the piston is in fluid communication with the bore of the inner string to allow fluid actuation of the piston housing.

7. The apparatus of claim 3, further comprising a biasing member operable to retract the piston relative to the inner string.

8. The apparatus of claim 1, further comprising a control mechanism operable to control fluid communication between the interior of the liner and the wellbore.

9. The apparatus of claim 8, wherein the control mechanism comprises a closure device adapted to engage an end of the liner to close fluid communication between the interior of the liner and the wellbore.

10. The apparatus of claim 1, further comprising an anchor device operable to couple the inner string to the liner to prevent axial movement therebetween.

11. The apparatus of claim 1, further comprising an expansion tool coupled to the inner string and operable to expand at least a portion of the liner.

12. The apparatus of claim 1, wherein the liner comprises a sand control screen.

13. The apparatus of claim 1, wherein the liner comprises an inner liner and an outer liner.

14. A method of running a liner into a wellbore, comprising:

positioning an inner string in the liner, wherein the inner string comprises a seal member operable to engage the interior of the liner;

pressurizing an internal area between the seal member and the interior of the liner to provide a pressure force against the interior of the liner; and displacing the liner relative to the inner string using the pressure force.

15. The method of claim 14, wherein the seal member comprises a seal cup operable to sealingly engage the interior of the liner.

16. The method of claim 14, further comprising:

securing the inner string to the liner;

running the liner into the wellbore using the inner string until progress is impeded by frictional resistance of the wellbore; and releasing the liner from the inner string.

17. The method of claim 14, further comprising cementing the liner into the wellbore.

18. The method of claim 14, further comprising de-pressurizing the internal area between the seal member and the interior of the liner, and relocating the inner string relative to the liner.

19. The method of claim 14, further comprising re-pressurizing the internal area between the seal member and the interior of the liner after the inner string is relocated to provide the pressure force against the interior of the liner to run the liner further into the wellbore.

20. The method of claim 14, further comprising expanding at least a portion of the liner.

21. The method of claim 14, further comprising expanding at least an upper portion of the liner into engagement with a casing.

22. The method of claim 14, wherein the liner comprises an expandable screen, and further comprising expanding the expandable screen.

23. The method of claim 14, wherein the liner comprises an inner liner and an outer liner, and wherein the displacing the liner comprises displacing the inner liner.

24. The method of claim 23, further comprising expanding a portion of at least one of the inner liner and the outer liner.

25. A method of running a liner into a wellbore, comprising:

positioning an inner string into the liner, wherein the inner string comprises a piston operable to engage the interior of the liner;

actuating the piston to engage the interior of the liner; and displacing the liner relative to the inner string using the piston.

26. The method of claim 25, further comprising:

securing the inner string to the liner;

running the liner into the wellbore using the inner string until progress is impeded by frictional resistance of the wellbore; and releasing the liner from the inner string.

27. An apparatus for running a liner into a wellbore, comprising:

an inner string having a bore therethrough;

a tubular engagement device coupled to the inner string, wherein the device is operable to engage the interior of the liner and facilitate movement of the liner relative to the inner string using a fluid pressure; and an anchor device operable to couple the inner string to the liner to prevent axial movement therebetween.

28. An apparatus for running a liner into a wellbore, comprising:

an inner string having a bore therethrough;

a tubular engagement device coupled to the inner string, wherein the device is operable to engage the interior of the liner and facilitate movement of the liner relative to the inner string using a fluid pressure; and an expansion tool coupled to the inner string and operable to expand at least a portion of the liner.

29. A method of running a liner into a wellbore, comprising:

securing an inner string to the liner;

running the liner into the wellbore using the inner string;

releasing the liner from the inner string;

closing a valve disposed in the inner string, thereby isolating the inner string from the liner; and pressurizing the inner string, thereby actuating a jack to engage an interior of the liner and operating a piston to advance the liner further into the wellbore.

30. The method of claim 29, wherein the liner is run-in until progress is impeded by frictional resistance of the wellbore.

31. The method of claim 29, further comprising expanding an upper portion of the liner into engagement with a casing.

32. The method of claim 29, further comprising cementing the liner into the wellbore.

33. The method of claim 29, further comprising:

depressurizing the internal area;

moving the inner string down the liner; and re-pressurizing the internal area, thereby advancing the liner further into the wellbore.

34. The method of claim 29, wherein:

the liner comprises an expandable screen, and the method further comprises expanding the expandable screen.

35. The method of claim 29, wherein pressurizing the inner string actuates two jacks to engage an interior of the liner and operates two pistons to advance the liner further into the wellbore.

* * * * *

UNITED STATES PATENT AND TRADEMARK OFFICE

CERTIFICATE OF CORRECTION

PATENT NO. : 7,699,113 B2
APPLICATION NO. : 12/206544
DATED : April 20, 2010
INVENTOR(S) : Lev Ring It is certified that error appears in the above-identified patent and that said Letters Patent is hereby corrected as shown below:

In the Claims:

Column 7, Claim 19, Line 30, after "The method of claim", please delete "14" and insert --18--.

Signed and Sealed this
Fifteenth Day of May, 2012

David J. Kappos

David J. Kappos
*Director of the United States Patent and Trademark Office*